US005288212A

United States Patent [19]

Lee

[11] Patent Number: 5,288,212

[45] Date of Patent: Feb. 22, 1994

[54] CYLINDER HEAD OF HERMETIC RECIPROCATING COMPRESSOR

[75] Inventor: In S. Lee, Seoul, Rep. of Korea

[73] Assignee: Goldstar Co., Ltd., Rep. of Korea

[21] Appl. No.: 53,821

[22] Filed: Apr. 29, 1993

Related U.S. Application Data

[63] Continuation of Ser. No. 805,590, Dec. 11, 1991, abandoned.

[30] Foreign Application Priority Data

Dec. 12, 1990 [KR] Rep. of Korea ..... 20422/1990
Dec. 13, 1990 [KR] Rep. of Korea ..... 20498/1990
Apr. 6, 1991 [LR] Liberia ..... 11462/1991

[51] Int. Cl.[5] ..... F04B 39/12

[52] U.S. Cl. ..... 417/312; 417/313; 417/902; 181/403; 181/229

[58] Field of Search ..... 417/312, 313, 439, 571, 417/902; 181/229, 403

[56] References Cited

U.S. PATENT DOCUMENTS

| | | | |
|---|---|---|---|
| 3,817,661 | 6/1974 | Ingalls et al. | 417/312 |
| 4,313,715 | 2/1982 | Richardson, Jr. | 417/902 |
| 4,370,104 | 1/1983 | Nelson et al. | 417/312 |
| 4,412,791 | 11/1983 | Lal | 417/902 |
| 4,573,880 | 3/1986 | Hirano et al. | 417/312 |
| 4,573,881 | 3/1986 | Romer | 417/902 |
| 4,730,695 | 3/1988 | Bar | 181/403 |
| 4,782,858 | 11/1988 | Fujiwara | 417/312 |
| 4,784,581 | 11/1988 | Fritchman | 417/312 |

FOREIGN PATENT DOCUMENTS

| | | | |
|---|---|---|---|
| 1123100 | 9/1956 | France | 181/403 |
| 8506 | 1/1977 | Japan | 417/312 |
| 3940617 | 6/1990 | Netherlands | 417/312 |

*Primary Examiner*—Richard A. Bertsch
*Assistant Examiner*—Roland G. McAndrews, Jr.
*Attorney, Agent, or Firm*—Ostrolenk, Faber, Gerb & Soffen

[57] ABSTRACT

A cylinder head of a hermetic reciprocating compressor comprising a main base mounted on a head plate of a cylinder of the compressor, an exhaust cover for exhausting a compressed fluid which was compressed in the cylinder, the exhaust cover being mounted on the main base, and a suction cover, including resonance chamber, for sucking a fluid which is to be compressed in the cylinder, the suction cover mounted on the main base so as to have a horizontal and vertical part, the horizontal and vertical part being spaced from the exhaust cover in a predetermined clearance. The present invention provides a cylinder head for a hermetic reciprocating compressor in which the temperature of the intake refrigerant gas is considerably reduced, thereby providing advantage in that it improves the compression efficiency of the compressor such as about 8% increase in case of 24 cc grade compressor and about 12% increase in case of 75 cc grade compressor.

3 Claims, 10 Drawing Sheets

CYLINDER HEAD OF HERMETIC RECIPROCATING COMPRESSOR

BACKGROUND OF THE INVENTION

This is a continuation of application Ser. No. 07/805,590, filed on Dec. 11, 1991, now abandoned.

FIELD OF THE INVENTION

The present invention relates to a cylinder head of a hermetic reciprocating compressor, and more particularly to a cylinder head of a hermetic reciprocating compressor which can prevent not only a pressure of an intake refrigerant gas from being lowered during a suction process of the refrigerant gas, by lessening a length of the supply line for the suction refrigerant gas at the maximum, but also for preventing a high temperature exhaust refrigerant gas from being transmitted to the suction refrigerant gas, thereby increasing the efficiency of the compressor.

DESCRIPTION OF THE PRIOR ART

With reference to FIGS. 1 and 2, a conventional hermetic reciprocating compressor comprises an upper and a lower casing 1, 2 defining a space therebetween, a frame 3 disposed at a middle portion of the space, a compressing part 4 mounted on the frame 3 and a driving motor part 5 mounted below the frame 3.

The compressing part 4 includes a cylinder 6 which is securely mounted on an upper surface of the frame 3 and a piston 7 which is reciprocatably inserted in the cylinder 6. The cylinder 6 is provided with a valve plate cover 8 at a rear portion thereof and the valve plate cover 8 is fixed at the rear portion by a plurality of set screws 9. As shown in FIG. 2, interposed between the cylinder 6 and the valve plate cover 8 are a suction valve 10 for introducing refrigerant gas therethrough, a valve plate 11, an exhaust valve 12 for discharging high pressed refrigerant gas therethrough and for preventing the high pressed refrigerant gas from flowing backward, an intermediate plate 13 which is formed with a suction hole **13*a* and an exhaust hole 13*b* at opposite sides thereof and a packing cover 14 for preventing the refrigerant gas from leaking and for sustaining a binding force of the cylinder 6 and the valve plate cover 8**.

The valve plate cover 8 comprises a main base 15 which is formed with suction holes **13*a*, 13*c* and exhaust holes 13*b*, 13*d* and a head cover 17 attached on the main base 15, so that a space for enabling refrigerant gas to flow is provided therebetween. Also, a suction guide 16 is mounted on the suction holes 13*a* and 13*c* of the main base 15 so as to guide refrigerant gas sucked through the suction hole 13*c* to the suction hole 13*a*. As a result of this structure, refrigerant gas is sucked through the suction hole 13*c* and 13*a* into the cylinder 6 and exhausted through the exhaust holes 13*b* and 13*d***.

In addition, the valve plate cover 8 is provided with a suction silencer 18 disposed under the suction hole **13*c* of the main base 15. The suction silencer 18 has a suction pipe 18' for communicating the cavity of the suction silencer 18 with the space defined by the casings 1, 2. Also, the valve plate cover 8 is provided with an exhaust silencer 19 disposed under the exhaust hole 13*d* of the main base 15. The exhaust silencer 19 has an exhaust pipe 19' for connecting the cavity of the exhaust silencer 19** with the outside of the space.

The driving motor part 5 comprises a crankshaft 20 connected to the piston 7 for reciprocating the piston 7, a stator 21 and a rotor 22.

In FIG. 1, reference numeral 23 designates an outer suction pipe, 24 designates an elastic supporting member and 25 designates a storing chamber for containing refrigerator oil.

During operation of the conventional hermetic reciprocating compressor, upon powering on the compressor, the crankshaft 20 is eccentrically rotated by means of a driving force of the driving motor part 5. Consequently, the piston 7 which is connected to the crankshaft 20 is reciprocated in the inner space **6*a* of the cylinder 7, so that refrigerant gas which has been sucked into the inner space 6*a*** is compressed.

Specifically, as the piston 7 retracts from the upper dead center to the lower dead center of the cylinder 6, the inner space **6*a* of the cylinder 6 forms a vacuum. Accordingly, due to a pressure difference between the inner space 6*a* and the outside, the refrigerant gas having a temperature of about 70° C., which has been sucked into the inside of the casings 1 and 2 through the outer suction pipe 23 (the refrigerant gas has about a 35° C. temperature before the gas is sucked into the inside of the casings 1 and 2, but has about a 70° C. temperature after being sucked into the inside), is sucked into the suction silencer 18 through the suction pipe 18' sucked into the inside of the suction guide 16 through the suction hole 13*c* and then, sucked into the inner space 6*a* of the cylinder 6 through the suction hole 13*a***.

Thereafter, as the piston 7 advances to the upper dead center of the cylinder 6, the refrigerant gas in the inner space **6*a* of the cylinder 6 is compressed, thus pushing the suction valve 10 in order to cause the suction hole 13*a* to be closed. In sequence, as the pressure of the refrigerant gas in the inner space 6*a* is increased, the refrigerant gas is exhausted into the space S of the head cover 17, by way of exhaust hole 13*b* and 13*d*, in turn, and then exhausted at a relatively higher temperature of about 110° C.–120° C. to the outside of the compressor through exhaust silencer 19**.

On the other hand, at the moment the suction hole **13*a* is opened the exhaust hole 13*b* is closed so that there does not occur a reverse flow of the refrigerant gas from the space S of the head cover 17 to the inner space 6*a* of the cylinder 6, and the space S of the head cover 17** efficiently makes the pressure pulsation as small as possible.

However, the above-mentioned conventional hermetic reciprocating compressor has the following disadvantages. That is, since the refrigerant gas is sucked along an intricate suction path in such a manner that the refrigerant gas is sucked into the inner space of the casings 1, 2 through the outer suction pipe 23 and then into the suction silencer 18 through the suction pipe 18, the pressure of the refrigerant gas is reduced as the refrigerant gas is sucked along the suction path. Moreover, since the valve plate cover 8 is constructed such that the main base 15 is provided with the suction guide 16 at a position of the suction holes **13*a* and 13*c* so as to guide the refrigerant gas having a temperature of 70° C. which has been introduced through the suction hole 13*c* to the suction hole 13*a*, and provided with the head cover 17 defining the space S so as to guide the refrigerant gas having a temperature between 110° C.–120° C., which has been exhausted through the exhaust hole 13*b* to the exhaust hole 13*d*, heat of the high temperature refrigerant gas in the space S is transmitted to the lower temperature refrigerant gas in the space formed between the suction guide 16 and the main base 15 by way of the suction guide 16, so that temperature of the lower temperature refrigerant gas in the space of the suction guide 16** is raised thereby causing density of the refrigerant gas to be lowered. Therefore, the efficiency of the compressor is decreased.

SUMMARY OF THE INVENTION

It is, therefore, an object of the present invention to provide a cylinder head of a hermetic reciprocating compressor in which the above-mentioned disadvantage is overcome and the suction cover and the exhaust cover are mounted on a main base of a cylinder head in order to be spaced apart from each other by a predetermined clearance, thereby preventing the heat transfer from an exhaust refrigerant gas of a relatively higher temperature to an intake refrigerant gas of a relatively lower temperature, thus efficiently preventing the efficiency reduction of the compressor, due to the temperature increase of the refrigerant gas.

It is another object of the present invention to provide a cylinder head of a hermetic reciprocating compressor which is provided with a resonance chamber disposed inside the suction cover, thereby reducing the noise occurrence during the suction of the intake refrigerant gas as much as possible.

The above-mentioned objects of the present invention can be accomplished by providing compressors, that is, a direct suction type of compressor, an indirect suction type of compressor, and a proximity type of compressor each classified according to the suction type of the refrigerant gas.

In an embodiment, the present invention provides a cylinder head of a hermetic reciprocating compressor comprising a combined silencer and suction cover and an exhaust cover which are mounted on both sides of a main base, so as to be disposed with a clearance therebetween, said suction cover having an inner suction pipe for allowing the refrigerant gas, which has been sucked into the inside of the shell of the compressor, to be indirectly sucked into the suction cover.

In another embodiment, the present invention provides a cylinder head of a hermetic reciprocating compressor comprising a combined silencer and suction cover and an exhaust cover which are mounted on both sides of a main base so as to be disposed with a clearance therebetween, said suction cover being connected to an outer suction pipe with a buffer spring member being disposed therebetween, the outer suction pipe being vertically disposed and penetrating the upper casing, thereby allowing the refrigerant gas to be directly sucked into the suction cover.

In still another embodiment, the present invention provides a cylinder head of a hermetic reciprocating compressor comprising a suction pipe laterally disposed at a side portion of the upper casing and penetrating the casing and protruding inward in order to have a predetermined inner clearance. The compressor is also provided with a combined silencer and suction cover which is mounted on a side of the main base so as to be spaced apart from an exhaust cover by a predetermined clearance. In addition, the suction cover comprises a horizontal part mounted on the main base communicating with the inner space of the cylinder by means of the suction hole, a vertical part comprising a resonance chamber disposed on an upper inside thereof and a suction chamber disposed at a lower inside thereof, and spaced apart from the outer wall of the cylinder by a predetermined clearance, and an inlet part having a smaller diameter than the suction pipe, mounted on a lower side portion of the vertical part in order to face the outer end thereof to the inner end of the larger diameter suction pipe with a predetermined clearance, thereby allowing the smaller diameter inlet part to communicate with the larger diameter suction pipe. As a result, a small part of the intake refrigerant gas is leaked into the inside of the shell of the compressor through the clearance in order to cool the refrigerant gas having a relatively higher temperature in the casing, the outer wall of the cylinder and the exhaust chamber. While, the other part of the intake refrigerant gas is sucked into the suction cover by way of the inlet part of the suction cover, which then passes through the resonance chamber in order to reduce the noise generated during the suction of the intake refrigerant gas, thereafter, last sucked into the inner space of the cylinder through the suction hole. In accordance, the compressor efficiently prevents the density of the intake refrigerant gas from being reduced due to the heat transfer from the exhaust cover and the cylinder of relatively higher temperature to the suction cover of relatively lower temperature, thereby improving the compressing efficiency thereof.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
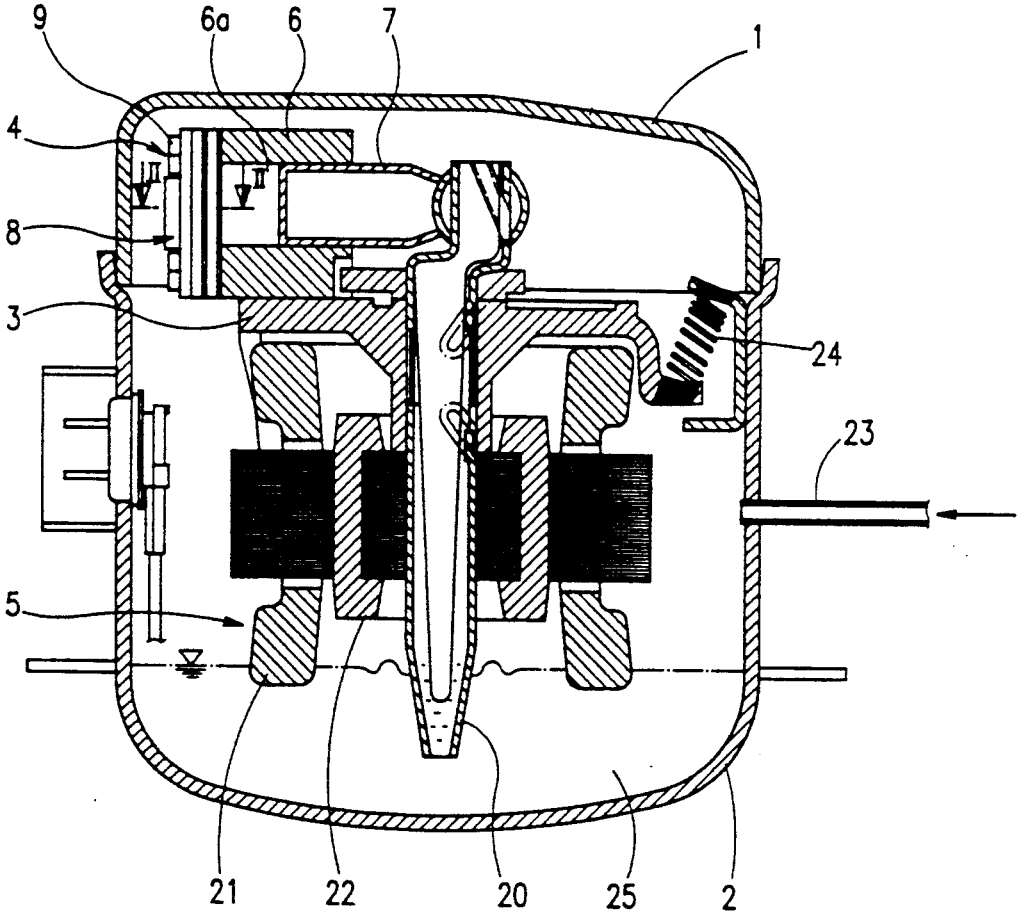
FIG. 1 PRIOR ART
FIG. 1 is a sectional view showing an inner construction of a hermetic reciprocating compressor in accordance with the prior art.
Figure 2:
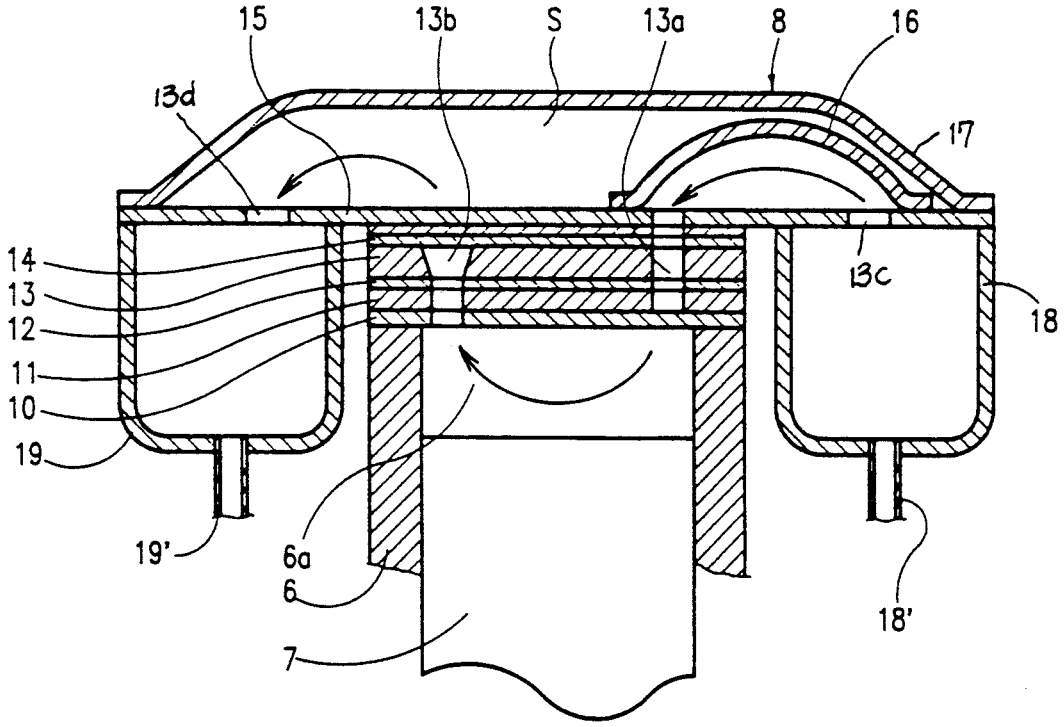
FIG. 2 PRIOR ART
FIG. 2 is a sectional view taken along the section line II—II of FIG. 1.

In the following description, the same reference numerals as those in the description of the known hermetic reciprocating compressor of FIGS. 1 and 2 have been used to denote the same elements.

Figure 3:
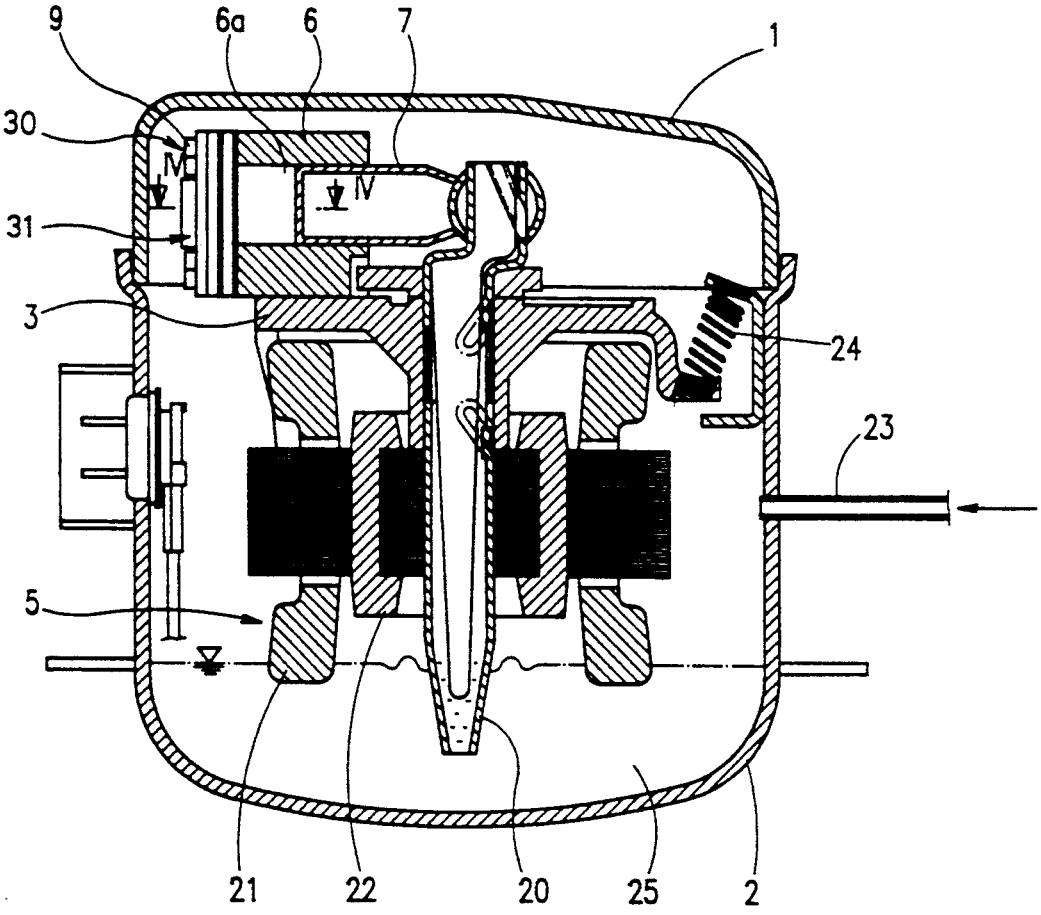
FIG. 3 is a view corresponding to FIG. 1, but showing an embodiment of the present invention.
Figure 4:
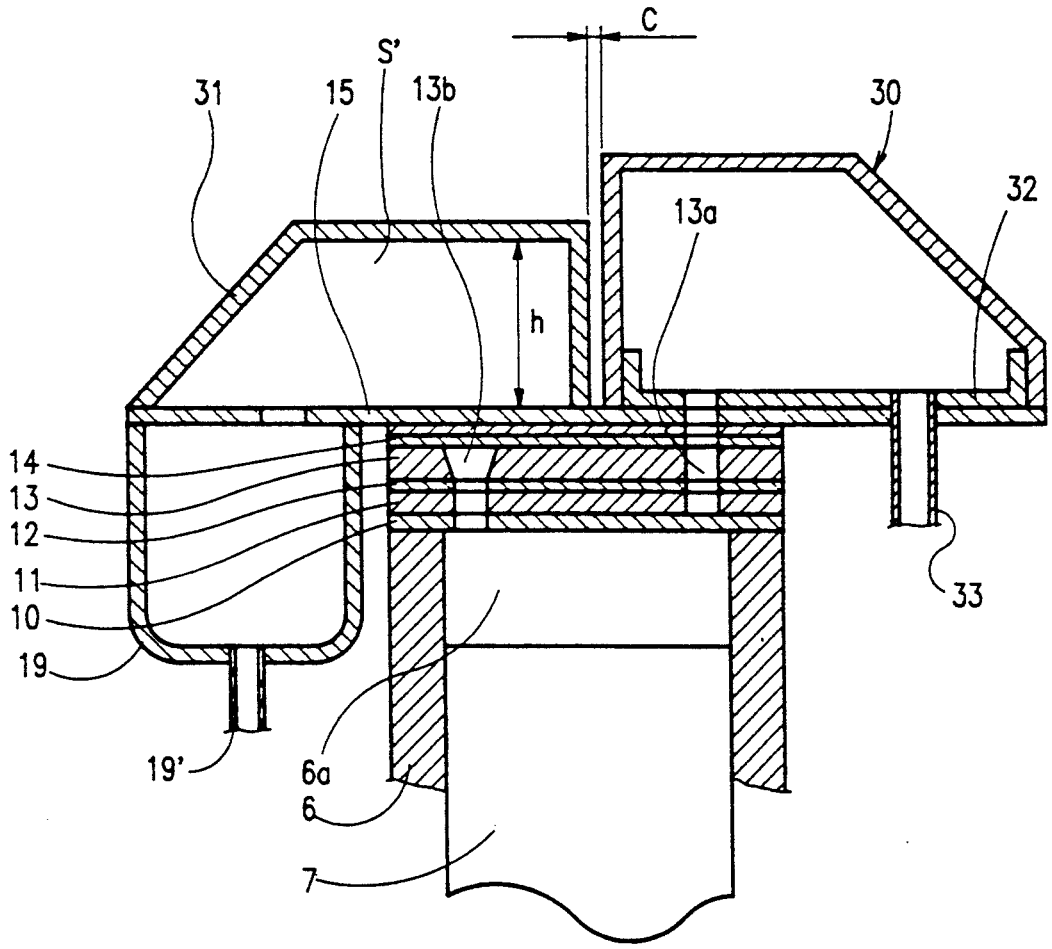
FIG. 4 is a sectional view taken along the section line IV—IV of FIG. 3.

Referring first to FIGS. 3 and 4 which show a first embodiment of a hermetic reciprocating compressor in accordance with the present invention, the compressor includes a combined silencer and suction cover 30 and an exhaust cover 31 which are mounted on both ends of a main base 15 so as to be disposed with a clearance "C" therebetween. In addition, a thermal insulation plate 32 such as a Teflon plate is laid on the main base 15 inside the combined silencer and suction cover 30, in order to prevent a heat transfer from the outside to the combined silencer and suction cover 30 as much as possible.

Here, the combined silencer and suction cover 30 and the exhaust cover 31 are made of a plastic material and mounted on the main base 15 by using a conventional tight fit method, respectively.

It is desired to construct the combined silencer and suction cover 30 (hereinafter, referred to simply as "the suction cover") so as to easily control its inner volume, in order to allow the suction cover 30 to carry out a silencing function similar to a conventional suction silencer. On the other hand, the exhaust cover 31 is constructed so as to be relatively higher than the conventional valve plate cover, taking account of the decreased inner area of the exhaust cover 31, so that the inner volume of the exhaust cover 31 is the same as that of the conventional valve plate cover. The reason why the suction cover 30 is constructed so as to have an easily controlled inner volume and the exhaust cover 31 is constructed in order to have the same inner volume as that of the conventional valve plate cover, are that the inner volume of the suction cover 30 considerably influences the noise which is generated during the suction of a fluid, such as an intake refrigerant gas, and the inner volume of the exhaust cover 31 considerably influences the volumetric efficiency of the refrigerant gas.

Here, the first embodiment as shown in FIGS. 3 and 4 shows an indirect suction type compressor which is provided with an inner suction pipe 33 vertically disposed and penetrating the thermal insulation plate 32 and the main base 15 at a bottom portion of the suction cover 30, in order to communicate with the inside of the shell of upper and lower casings 1 and 2 of the compressor, as shown in FIG. 4, thereby allowing the refrigerant gas which has been sucked into the inside of the shell through outer suction pipe 23 to be then sucked into the suction cover 30 through the inner suction pipe 33 after circulation in the inside of the shell of the casings 1 and 2 of the compressor.

The operation of the compressor according to the first embodiment of this invention will be described as follows.

Upon starting the compressor, a driving motor 5 drives a crankshaft 20 so that the crankshaft 20 eccentrically rotates, thereby causing a piston 7 connected to an upper end of the crankshaft 20 to reciprocate between the upper dead center and the lower dead center in the inner space 6*a* of a cylinder 6, in order to compress the refrigerant gas in the same manner as that of the known compressor.

Describing in more detail the above-mentioned operation of the compressor, as the piston 7 retracts to the lower dead center, the refrigerant gas having a temperature of about 70° C., which has been sucked into the inside of the shell of the casings 1 and 2 through the outer suction pipe 23, is sucked into the suction cover 30 through the inner suction pipe 33 after circulation in the shell, thereafter, and then sucked into the inner space 6*a* of the cylinder 6.

At this time, the suction cover 30 carries out the suction guide function thereof to guide the flow of the refrigerant gas into the inner space 6*a* of the cylinder 6, and simultaneously carrying out the silencing function such as that carried out by the conventional suction silencer by adjusting the inner volume thereof in order to have the same volume as that of the conventional suction silencer.

Thereafter, as the piston 7 advances to the upper dead center, the refrigerant gas in the inner space 6*a* of the cylinder 6 is compressed, thus pushing the suction valve 10 in order to cause the suction hole 13*a* to be closed, then in sequence, the refrigerant gas is exhausted into the inside space S' of the exhaust cover 31 by way of an exhaust valve 12 and an exhaust hole 13*b*, and then exhausted at a relatively higher temperature of about 110° C.–120° C. to the outside of the compressor through an exhaust silencer 19.

The exhaust cover 31 is independently displaced from the suction cover 30 under the condition that there is provided the predetermined clearance "C" between the exhaust cover 31 and the suction cover 30, as described above, so that the relatively higher temperature of the exhaust refrigerant gas in the exhaust cover 31 is efficiently restrained from being transferred therefrom to the suction refrigerant gas of relatively lower temperature in the suction cover 30. In addition, there is provided the thermal insulation plate 32 inside the suction cover 30 as described above, so that the relatively higher temperature of the exhaust refrigerant gas in the exhaust cover 31 is more efficiently restrained from being transferred to the suction refrigerant gas of relatively lower temperature in the suction cover 30.

On the other hand, in the same manner as that of the known hermetic reciprocating compressor, at the moment the suction hole 13*a* is opened, the exhaust hole 13*b* is closed so that there is no reverse flow of the refrigerant gas from the inner space S' of the exhaust cover 31 to the inner space 6*a* of the cylinder 6, and the inner space S' of the exhaust cover 31 efficiently make the pressure pulsation be as small as possible.

Figure 5:
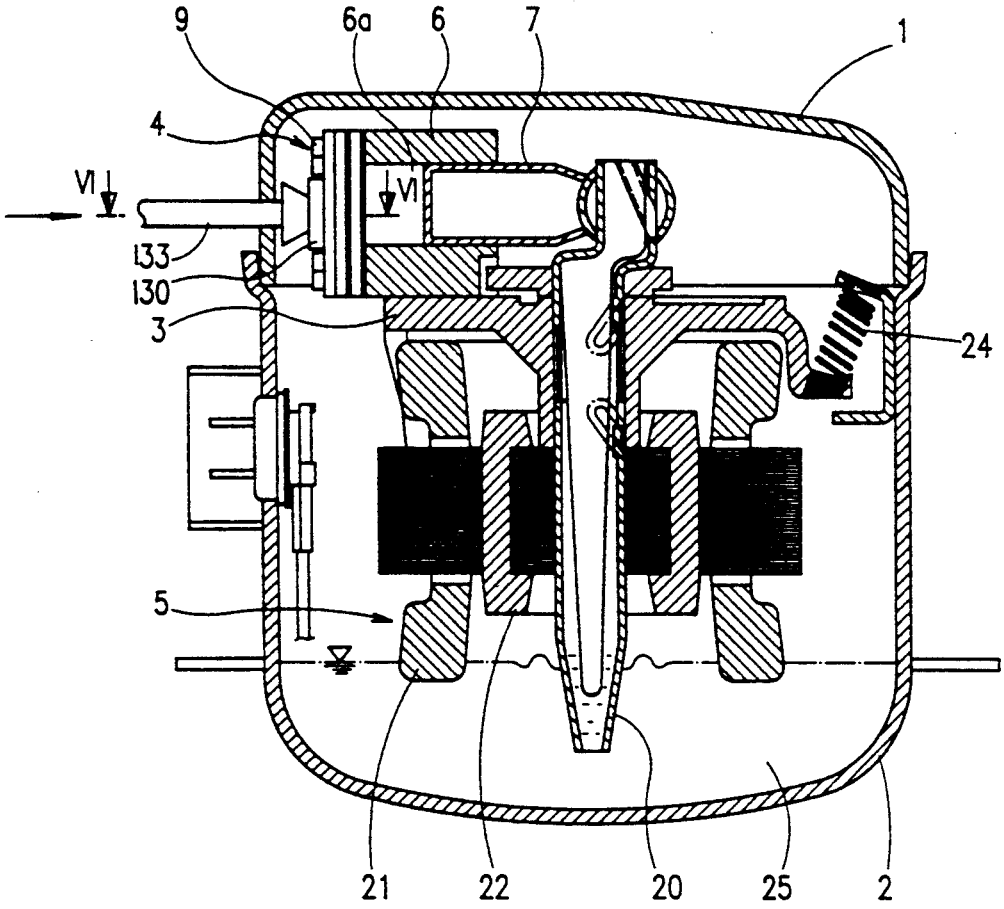
FIG. 5 is a view corresponding to FIG. 3, but showing another embodiment of the present invention.
Figure 6:
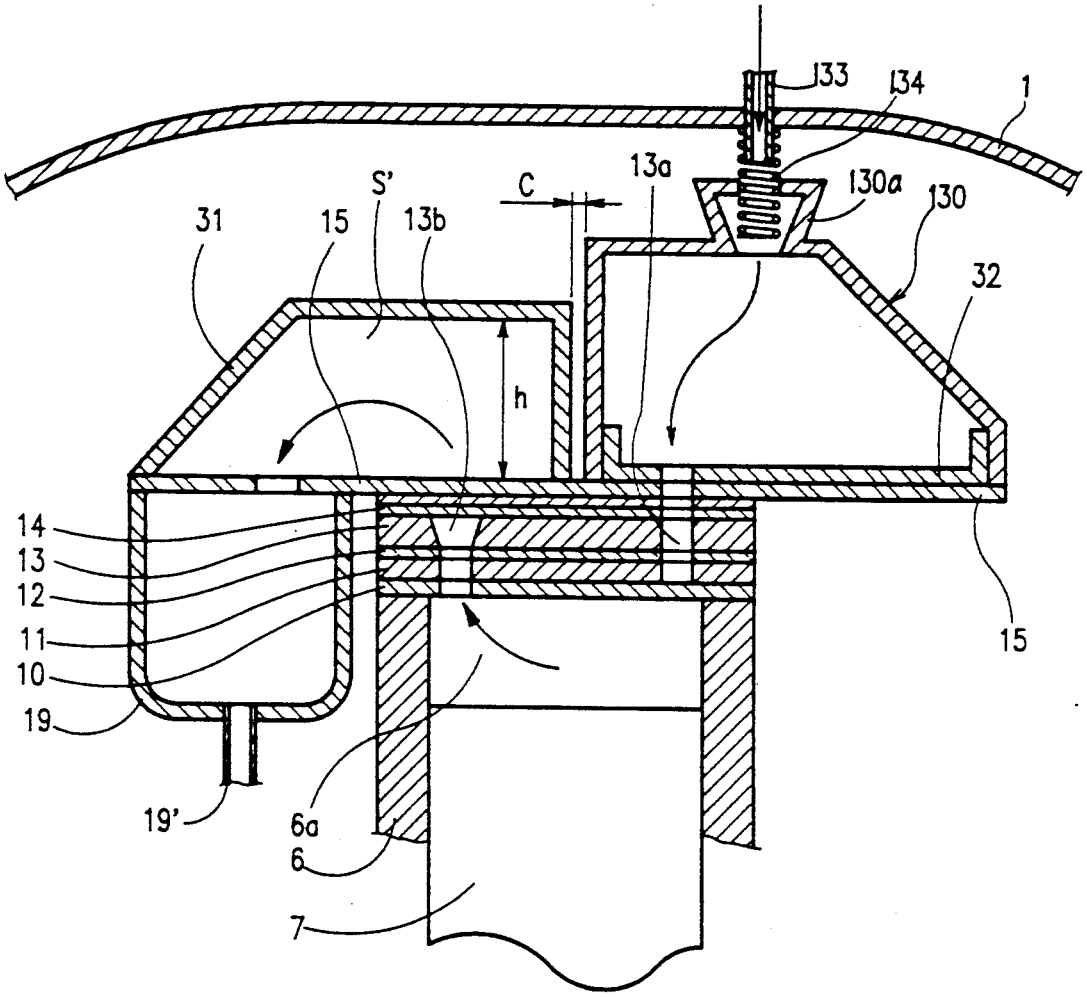
FIG. 6 is a sectional view taken along the section line VI—VI of FIG. 5.

FIGS. 5 and 6 are views showing a second embodiment of a hermetic reciprocating compressor in accordance with this invention, in which embodiment the present invention is applied to a direct suction type compressor in which the refrigerant gas is directly sucked into the suction cover without circulating in the inside of the casings 1 and 2, in order to prevent the pressure drop of the intake refrigerant gas.

Describing in detail the construction of the above second embodiment of the compressor, the compressor includes a combined silencer and suction cover 130 (hereinafter, referred to simply as "the suction cover") and the exhaust cover 31, which are mounted on both ends of the main base 15 so as to be disposed with a clearance "C" therebetween. The suction cover 130 has a suction part 130*a* which is integrally formed at an upper end of the cover and connected to a lower end of an outer suction pipe 133 which is vertically disposed to penetrate the upper casing 1, thereby allowing the inside of the suction cover 130 to communicate with the outside of the casing 1. The outer suction pipe 133 is connected to an upper end of a buffer spring member 34, such as a coil spring, as such that the lower end of the suction pipe is inserted into the upper end of the spring member 134. The buffer spring member 134 is inserted at a lower end thereof into the suction part 130*a* of the suction cover 130. The spring member 134 is adapted for absorbing the mechanical shock which may be generated during the compressing operation of the compressor, and may be comprised of a bellows or other resilient members besides the above-mentioned coil spring.

The second embodiment of the compressor has the same elements as those of the above-mentioned first embodiment except for the suction cover 130, and provides a similar operational effect as that of the first embodiment, except for the shortening of the flowing passage of the intake refrigerant gas and the prevention of the pressure drop of the refrigerant gas, thus a more detailed description of the construction and the operational effect of the second embodiment is omitted, for simplicity.

Figure 7:
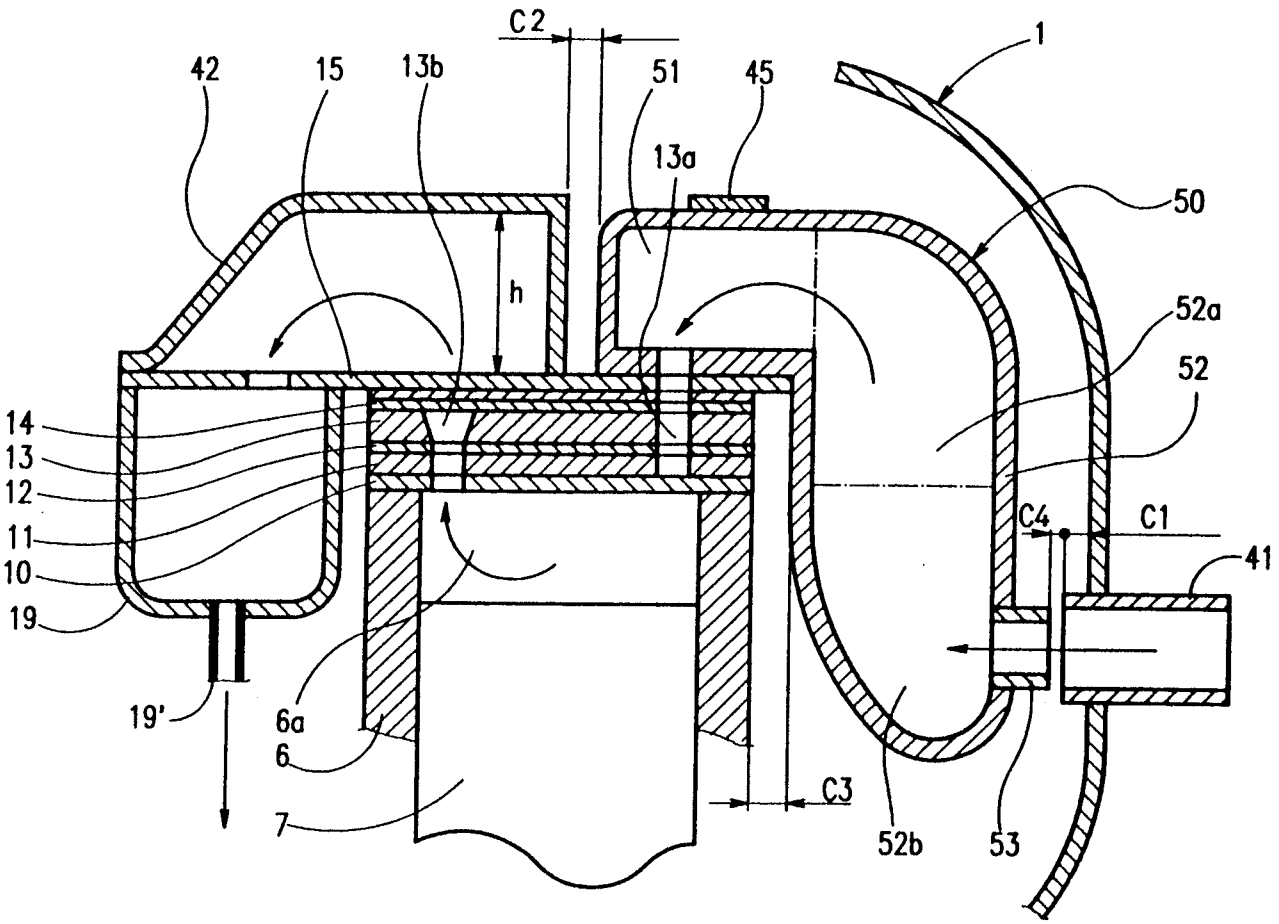
FIG. 7 is a sectional view showing a cylinder head of still another embodiment of a hermetic reciprocating compressor in accordance with the present invention.
Figure 8:
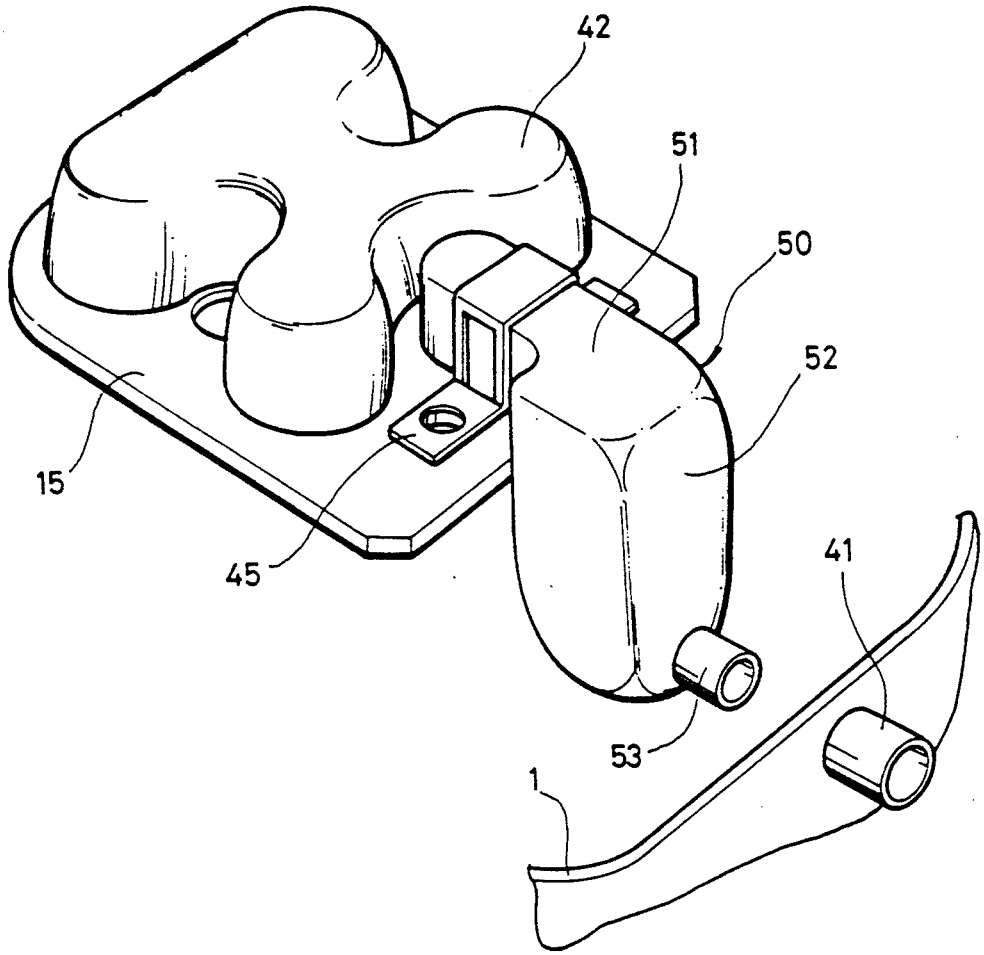
FIG. 8 is a perspective view of a suction cover of FIG. 7.

FIGS. 7 and 8 show a third embodiment of a hermetic reciprocating compressor according to this invention, in which embodiment the present invention is applied to a proximity type compressor resulting from making a compromise between the direct suction type and indirect suction type compressors. The proximity type compressor can overcome the problems which may occur in the above-mentioned two types of compressors of this invention, that is, the noise occurrence due to the direct suction of the refrigerant gas in the direct suction type compressor and the pressure drop due to the indirect suction of the refrigerant gas in the indirect suction type of compressor.

Describing in detail, this embodiment of compressor includes a suction pipe 41 laterally disposed at a side portion of the upper casing 1, penetrating the casing 1 and protruding inward so as to have a predetermined inner clearance C1. The compressor is also provided with a combined silencer and suction cover 50 (hereinafter, referred to simply as "the suction cover") which is made of a plastic material and mounted on a side of the main base 15 so as to be spaced apart from an exhaust cover 42 by a predetermined clearance C2. In addition, the suction cover 50 generally comprises a horizontal part 51, a vertical part 52 and an inlet part 53. The horizontal part 51 is mounted on the main base 15 and communicates with the inner space 6*a* of the cylinder 6 by means of the suction hole 13*a*. The vertical part 52 comprises a resonance chamber 52*a* at an upper inside thereof and a suction chamber 52*b* at a lower inside thereof, and is spaced apart from the outer wall of the cylinder 6 by a predetermined clearance C3. The inlet part 53 is mounted on a lower side portion of the vertical part 52. The outer end of the inlet part 53, having a smaller diameter than the suction pipe 41, faces the inner end of the larger diameter suction pipe 41 and is separated by a predetermined clearance C4, thereby allowing the smaller diameter inlet part 53 to communicate with the larger diameter suction pipe 41.

In FIGS. 7 and 8, the reference numeral 45 denotes a clamping clamp for keeping the suction cover 50 to the main base 15.

The operation of the compressor according to the third embodiment of this invention will be described as follows.

Upon getting the compressor started, the driving motor 5 drives a crankshaft to cause the piston 7 to reciprocate in the cylinder between the upper dead center and the lower dead center. As a result, the refrigerant gas is first sucked into the suction cover 50 through the suction pipe 41, then sucked into the inner space 6*a* of the cylinder 6 through the suction hole 13*a*.

At this time, the inner end of the larger diameter suction pipe 41 faces the outer end of the smaller diameter inlet part 53 of the suction cover 50, so as to have the predetermined clearance C4 therebetween as described above, so that a small part (about 5%) of the intake refrigerant gas is leaked into the inside of the shell of the casings 1 and 2 through the clearance C4, in order to cool the refrigerant gas having a relatively higher temperature of about 65° C.–75° C. in the casings 1 and 2, the outer wall of the cylinder 6 and the exhaust chamber 42. While, the other part (about 95%) of the intake refrigerant gas is sucked into the suction cover 50 by way of the inlet part 53 of the suction cover 50, then passes through the resonance chamber 52*a* in order to reduce the noise being generated during the suction of the intake refrigerant gas, and thereafter, is then sucked into the inner space 6*a* of the cylinder 6 through the suction hole 13*a*. The refrigerant gas in the inner space 6*a* of the cylinder 6 is compressed by means of the piston 7 advancing to the upper dead center, then exhausted to the outside of the compressor by way of the exhaust hole 13*b*, the exhaust cover 42 and the exhaust silencer 19, sequentially.

Accordingly. the third type of compressor according to this invention provides an advantage in that it is provided with a predetermined clearance C4 between the larger diameter suction pipe 41 and the smaller diameter inlet part 53 of the suction cover 50 in order to provide the advantages of the direct type of the compressor and the indirect type of compressor according to this invention. Furthermore, it is provided with predetermined clearances C2 and C3 between the suction cover 50 and the exhaust cover 42 and also the cylinder 6, respectively, thereby efficiently preventing the density of the intake refrigerant gas from being reduced due to the heat transfer from the exhaust cover 42 and the cylinder 6 having a relatively higher temperature then the suction cover 50 having a relatively lower temperature.

In addition, the third type of compressor provides an advantage in that it is provided with the resonance chamber 52*a* in the suction cover 50, thereby efficiently reducing the noise which is generated during the suction of the refrigerant gas.

Figure 9:
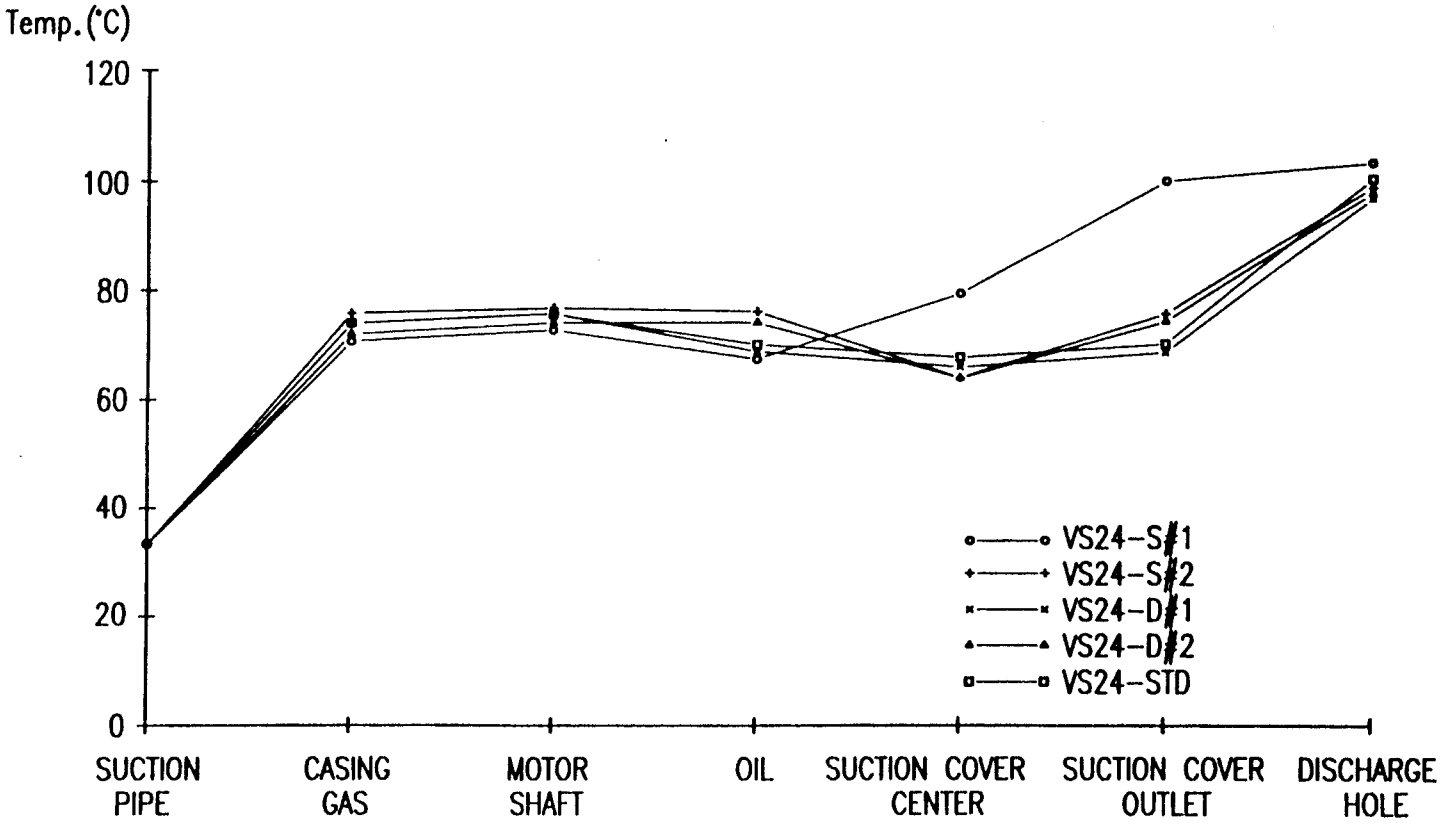
FIG. 9 is a comparative graph showing temperatures measured around respective outlet ports of the suction covers of the known hermetic reciprocating compressor and the hermetic reciprocating compressor of FIG. 7.
Figure 10:
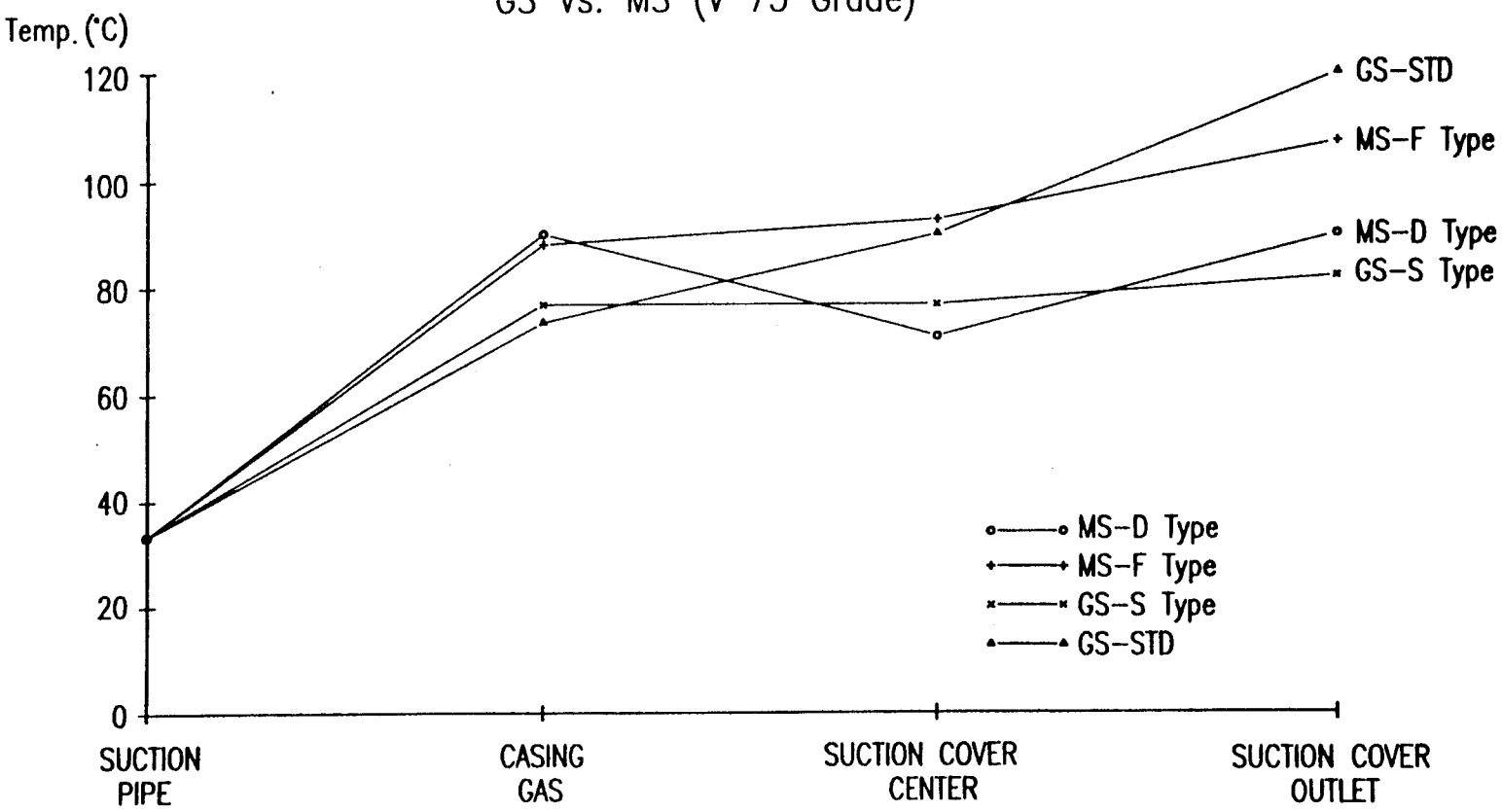
FIG. 10 is a comparative graph showing temperatures of exhaust gas exhausted out of the outlet ports of the suction covers of known hermetic reciprocating compressors which are manufactured by Matsusita company of Japan and provided with the cylinder head of this invention, and the hermetic reciprocating compressors of this invention.

The experimental results of the performances of the embodiments of the compressors in accordance with this invention are shown in the comparative graphs of FIGS. 9 and 10.

First, FIG. 9 shows a comparative graph in which respective temperatures measured around the outlet ports of the suction covers, that is, the suction holes communicating with the cylinders, of a known standard model of compressor (24 cc grade) and a plurality of models of compressors (S#1, S#2, D#1 and D#2) in accordance with this invention are comparatively represented, respectively. According to the graph of FIG. 9, the temperature around the outlet port of the suction cover of the known standard model (24 cc grade) is at a relatively higher temperature of about 98° C., while the temperatures around the outlet ports of the suction covers of the models of compressors (S#1, S#2, D#1 and D#2) in accordance with this invention are at a relatively lower temperature of about 64° C.–70° C. As a result, it is well known that the intake refrigerant gas, in the case of the compressors of the present invention, is sucked into the cylinder 6 under a relatively lower temperature condition than that of the known compressors.

On the other hand, FIG. 10 shows a comparative graph in which respective temperature of the intake refrigerant gases measured around the outlet ports of the suction covers of models (GS) of the compressors in accordance with this invention and other models in which the suction cover of this invention is applied to a known model (MS, 75 cc grade) of compressor manufactured by Matsusita company of Japan are comparatively represented, respectively. According to the graph of FIG. 10, it is well known that the intake refrigerant gas in case of the model (GS-S type) of the present invention is sucked into the cylinder 6 under a relatively lower temperature condition of about 10° C., than that of the known model compressor (MS-D type).

As described above, the present invention provides a cylinder head for a hermetic reciprocating compressor in which the temperature of the intake refrigerant gas in considerably reduced, thereby providing advantage in that it improves the compression efficiency of the compressor such as about 8% increase in case of 24 cc grade compressor and about 12% increase in case of 75 cc grade compressor.

Although the preferred embodiments of the present invention has been disclosed for illustrative purpose, those skilled in the art will appreciate that various modifications, additions and substitutions are possible, without departing from the scope and spirit of the invention as disclosed in the accompanying claims.

What is claimed is:

1. A cylinder head of a hermetic reciprocating compressor, comprising;

a main base mounted on a head plate of a cylinder of said compressor;

exhaust means for exhausting a compressed fluid which was compressed in said cylinder, said exhaust means being mounted on said main base;

suction means for sucking a fluid into the cylinder where the fluid is compressed, said suction means being mounted on the main base so as to be spaced apart from said exhaust means by a predetermined clearance, said suction means comprising a horizontal part communicating with an inner space of the cylinder by means of a suction hole, a vertical part comprising a resonance chamber for reducing noise generated during the suction of the fluid and a suction chamber provided at a lower inside portion of said vertical part of said suction means; and a suction pipe member for sucking said fluid, said suction member comprising a first pipe member mounted on a casing of the compressor for sucking the fluid into the inside of the casing of the compressor, and a second pipe member disposed inside the casing and mounted on said vertical part of said suction means for guiding a portion of the fluid into the suction chamber, said first pipe member having a diameter larger than a diameter of said second pipe member and being spaced apart from said second pipe member by a predetermined clearance so that the fluid not received by the suction chamber through said second pipe member is circulated in the casing.

2. A cylinder head according to claim 1, wherein said suction means is spaced apart from the exhaust means by a predetermined clearance, thereby preventing heat transfer between the suction means and the exhaust means.

3. A cylinder head according to claim 1, wherein said vertical part extends from a side wall of the cylinder so as to be spaced apart from the cylinder by a predetermined clearance, thereby preventing heat transfer between the cylinder and the suction means.

* * * * *